United States Patent [19]

Jacobs et al.

[11] 4,139,250

[45] Feb. 13, 1979

[54] GAS DISCHARGE DISPLAY PANEL AND METHOD OF MANUFACTURING THE SAME

[75] Inventors: Jacobus H. Jacobs; Johannes Van Esdonk; Johannes P. T. Franssen, all of Eindhoven, Netherlands

[73] Assignee: U.S. Philips Corporation, New York, N.Y.

[21] Appl. No.: 856,343

[22] Filed: Dec. 1, 1977

Related U.S. Application Data

[63] Continuation of Ser. No. 732,358, Oct. 14, 1976, abandoned.

[30] Foreign Application Priority Data

Oct. 27, 1975 [NL] Netherlands ..... 7512517

[51] Int. Cl.[2] ..... H01J 9/18; H01J 9/38

[52] U.S. Cl. ..... 316/19

[58] Field of Search ..... 316/19, 17, 18

[56] References Cited

U.S. PATENT DOCUMENTS

| | | | |
|---|---|---|---|
| 2,933,648 | 4/1960 | Bentley | 315/169 |
| 3,778,126 | 12/1973 | Wilson | 316/20 |
| 3,778,127 | 12/1973 | Langston, Jr. | 316/20 |

*Primary Examiner*—Richard B. Lazarus

*Attorney, Agent, or Firm*—Carl P. Steinhauser

[57] ABSTRACT

A vacuum-tight seal is produced between plate-shaped elements one of which is glass, of a gas discharge display device while maintaining such a pressure on the surface of the elements that they are brought in permanent contact with a spacing member which separates them. Furthermore, at least the glass face plate is preferably heated to such a high temperature that a possible elastic deformation of said element resulting from a pressure exerted on the surface thereof is converted into a plastic deformation.

4 Claims, 2 Drawing Figures

GAS DISCHARGE DISPLAY PANEL AND METHOD OF MANUFACTURING THE SAME

This is a continuation of application Ser. No. 732,358, filed Oct. 14, 1976, now abandoned.

The invention relates to a method of manufacturing a gas discharge display panel in which a first plate-shaped glass element is sealed in a vacuum-tight manner to a second plate-shaped element only along a closed path, a defined space being maintained between said elements by means of at least one spacing member situated inside the closed path.

The invention furthermore relates to a gas discharge display panel manufactured according to the method.

The development of gas discharge panels for displaying information in the form of digits, letters and television pictures has of late been directed mainly to the manufacture of panels which, as regards picture size, can compare with that of the preset-day cathode ray tubes. It has been found that certain methods which are usual in the manufacture of small panels, that is to say panels smaller than 10 × 10 cm, cannot be used as such in manufacturing panels of larger dimensions. Problems occur notably when in one of the last phases of the manufacturing process a negative pressure with respect to the ambient pressure outside the panel is provided in the panel and the space between the plate-shaped elements is filled with a suitable ionisable gas. As a result of said negative pressure there is a risk of a fracture occurring in the seal joining the plate-shaped elements so that the panel is useless.

Investigations have proved that the cause of said fracture is mainly a result of the fact that the plate-shaped elements, such as a glass plate, are not entirely flat. Deviations of 250 μm are no exception. It may occur that one or both plate-shaped elements are not supported by a spacing member over too large a surface. As a result of this, during providing a negative pressure in the panel, at least one of said plate-shaped elements sags so that the connection seam between said elements is loaded too heavily.

A considerable improvement in this respect would be obtained if in assembling the panel the starting material were entirely flat plate-shaped elements. However, such a solution is not attractive economically because for that purpose the elements would have to be subjected to an extra and usually expensive treatment.

It is an object of the invention to provide a method of manufacturing a gas discharge display panel in which the occurrence of fracture as a result of negative pressure in the panel is avoided.

According to the invention, a method of the kind mentioned in the preamble is characterized in that the vacuum-tight seal between the elements is effected while maintaining such a pressure on the surface of the plate-shaped element that said elements are brought into permanent contact with the said spacing member.

When the plate-shaped elements have been brought into contact with the spacing member and in that state the final sealing of the panel is effected, the load on the seal between the elements tends to remain more constant during later stages of manufacture. According to the invention, such a contact can be realised in a simple manner if a pressure which is at least equal to the pressure which was necessary to contact the elements with the said spacing member is maintained on the surface of the plate-shaped elements from the point in the process at which these elements are sealed together up to and including the sealing of the exhaust tube of the gas discharge display panel.

Such a contact is preferably effected by providing in the said space between the elements a negative pressure with respect to the ambient pressure of the panel.

Suitably at least the said first plate-shaped glass element is furthermore heated to such a high temperature below the softening temperature of the glass from which it is manufactured that a possible elastic deformation of said element, obtained by a pressure exerted on the surface thereof, is converted into a plastic deformation. Softening temperature is to be understood to mean herein that temperature at which the glass just does not deform under its own weight. The advantage of this embodiment of the method according to the invention is that immediately after producing the vacuum-tight connection between the elements, the negative pressure in the panel can be removed without any objection. The panel may then be filled with a suitable ionisable gas to any desired pressure smaller than or equal to the atmospheric pressure.

For converting a possible elastic deformation into a plastic deformation it is not necessary to heat the glass plate or plates up to softening temperature as defined above. Already at a considerably lower temperature than the softening temperature meant here can the object of the invention be realised. A suitable choice of this temperature is determined in general by the type of sealing and the type of sealing material which is used to seal the plate-shaped elements together. Furthermore, the choice of temperature is associated with the way in which the temperature can best be fitted in the manufacturing process, while the construction of the panel itself with respect to such a choice may also play an important part.

According to the invention, preferably at least the first plate-shaped glass element is heated to a temperature which is approximately equal to the lowest strain point of the glass (from which it is manufactured), that is that temperature at which the glass has a viscosity of $10^{14.5}$ poises. In this connection "approximately" is to be understood to mean a spreading of 30° C. relative to the lowest strain point. It has been found, rather surprisingly, that even at temperatures below the lowest strain point an elastic deformation of the glass plate can be converted into a permanent deformation within a reasonable time. This time becomes the shorter as the temperature is higher.

The advantage of the invention is that a thin glass plate of normal window glass may be used even for large panels.

The invention will be described in greater detail with reference to the drawing, in which.

Figure 1:
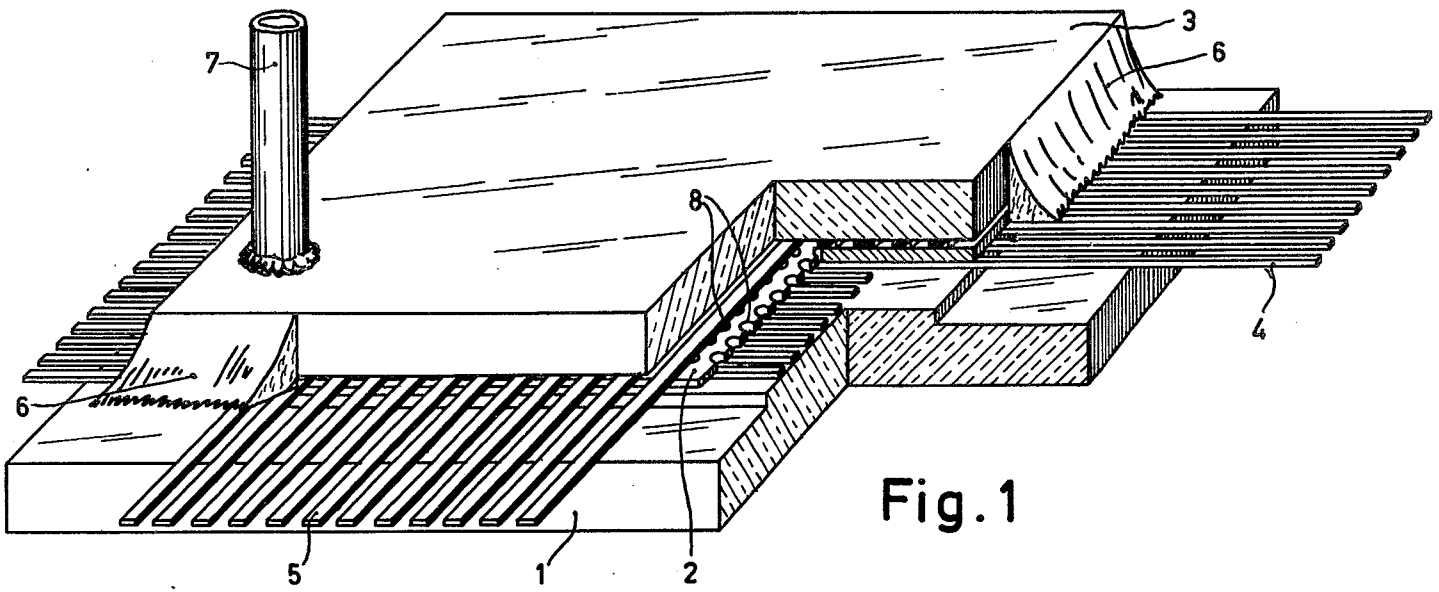
FIG. 1 shows a gas discharge display panel partly broken away.

The gas discharge panel shown in FIG. 1 comprises a first plate-shaped element 1 consisting of a 4 mm thick glass face plate of 32 × 32 cm. A second plate-shaped element 3 consisting of a 4 mm thick glass rear plate is maintained at a defined distance from the plate 1 by means of a spacing member 2, consisting of a 0.3 mm thick intermediate plate of anodised aluminum. The face plate 1 and the rear plate 3 consist of glass having substantially the following composition: 69.1% by weight of $SiO_2$, 9% by weight of $Na_2O$, 7.4% by weight of $K_2O$, 9.7% by weight of CaO, 2.8% by weight of BaO. This glass has a lowest strain point of 505° C. (viscosity $10^{14.5}$ poises). In a modification the rear plate need not consist of glass but may be any insulating material which is suitable for this application, for example ceramic. Furthermore, the spacing member 2 need not consist of one plate but separate spacing members distributed over the surface of the face plate may alternatively be used. The gas discharge panel illustrated has a first set of electrodes 4 disposed between the rear plate 3 and the intermediate plate 2, and a second set of electrodes 5 disposed between the face plate 1 and the intermediate plate 2. Each electrode 4 crosses each electrode 5 and at the area of such a crossing there is a perforation 8 in the intermediate plate 2. In this manner each crossing defines a gas discharge cell and all the crossings together constitute a matrix of gas discharge cells each of which can be ignited selectively by applying a suitable potential difference between an electrode 4 and an electrode 5. If desired, grooves may be provided in the face plate and the rear plate respectively, in which the electrodes 4 and 5, are located. By choosing the depth of said grooves to be such as to determine the required distance between the electrodes 4 and the electrodes 5, the intermediate plate 2 may be omitted and the ridges between the grooves constitute the spacing members as referred to above.

After assembling the parts as shown in the drawing, which may be carried out in a jig, the face plate 1 and the rear plate 3 are connected together in a vacuum-tight manner along a closed path only, in this case along the edge of the rear plate, by means of a sealing material 6. The sealing material is a crystallizing (devitrifying) glass and is applied in the form of a suspension of glass powder in a solution of 1% nitrocellulose in amyl acetate. A viscosity of the suspension suitable for this application is obtained with a composition of 10 parts by weight of glass powder in 1 part by weight of binder.

After evaporating the amyl acetate from the suspension, the assembly is heated in an oven to a temperature of 440° C. at which some devitrification of the sealing material starts to take place. The increase of viscosity of the sealing material associated with said devitrification is such as to permit a negative pressure of approximately 5 cm mercury in the panel with respect to the ambient pressure without the sealing material being sucked into the panel to an unacceptable distance. As a result of said negative pressure, the face plate and the rear plate are deformed elastically in places where, as a result of their unsmoothness, they do not bear against the intermediate plate 2 until they contact the plate in places distributed over the surface. At this stage the sealing material 6 is still so soft that it does not prevent relative movement between the plates. The temperature is now raised to 485° C. and maintained there for 30 minutes, the elastic deformation of the plates being converted into a permanent defomation and the sealing material being converted at least partly into a crystalline phase. The panel is finally cooled after which the space in the panel is filled with an ionisable gas, such as for example, neon, argon, xenon, and the exhaust tube 7 is sealed.

The above-described method is only one of the many possibilities. The procedure described may be altered in a number of ways. For example, it is possible to maintain in the panel the negative pressure of 5 cm mercury for a restricted period of time, for example, 10 minutes, and to increase said negative pressure to, for example, 40 cm mercury with the raising of the temperature to 485° C. The advantage of this larger negative pressure is that the electrodes are subject to oxidation to a lesser extent and a possible oxide skin is rapidly sputtered away from the cathodes during the initial operation of the panel.

Figure 2:
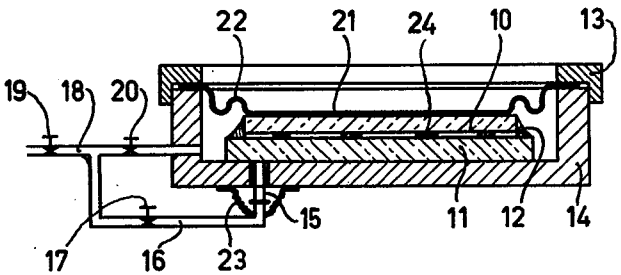
FIG. 2 shows a phase in an embodiment of the method according to the invention.

FIG. 2 shows diagrammatically in what manner the object according to the invention can be achieved other than by means of a negative pressure in the panel. The envelope of the panel again consists of two plates 10 and 11 which are sealed together only along the edge of the glass plate 10 by means of a suspension of a devitrifiable glass 12. The assembly is accommodated in a metal housing 14 which can be closed in a vacuum-tight manner by means of a cover 13, the exhaust tube 15 of the panel being inserted through an aperture in the base plate of the housing 14. The exhaust tube 15 communicates with an exhaust duct 16 having a cock 17, the aperture in the base plate of the housing 14 being sealed hermetically from the atmosphere by means of a bellows seal 23. The exhaust duct 16 communicates at one end with a second exhaust duct 18, which communicates with the space surrounded by the housing 14 and which has two cocks 19 and 20. The cover 13 consists of an aluminum foil 21 having expansion bellows 22. With the cocks 17, 19 and 20 in the opened position, the interior of the housing 14 and the gas discharge panel accommodated therein is evacuated by means of a pumping set not shown. The ambient pressure transferred to the plate 10 via the aluminum foil 21 presses the plates 10 and 11 towards each other until they come into contact with the spacing members 24 between the plates. By means of an analogous temperature treatment as described with reference to FIG. 1, the elastic deformation of the plates 10 and 11 is again converted into a permanent deformation, the connection material 12 being devitrified. After cooling the assembly, the cock 17 is closed and air is admitted to the housing 14 via the duct 18, after which the cover 13 is removed. The cock 20 is then closed and the duct 8 evacuated. The cock 17 is finally opened again and the panel is filled with a suitable ionisable gas via the ducts 18 and 16, after which the exhaust tube 15 is sealed and the panel is taken out of the housing 14 ready for operation.

Although the invention has been explained with reference to examples in which the sealing material consists of a devitrifiable glass, it is by no means restricted thereto. Other sealing or connection material and even other connection methods may be used without departing from the scope of this invention.

We claim:

1. Method of manufacturing a gas discharge display panel comprising a first plate-shaped glass element, a second plate-shaped element, a spacing member intermediate said plate-shaped elements and a tubulation for exhausting and back-filling said panel, the method comprising the steps of assembling said plate-shaped elements and said intermediate spacing member, placing a heat fusible sealing material in contact with said plate-shaped elements along a closed path surrounding said spacing member, exerting a uniform pressure on the entire surface of at least one of the plate-shaped elements sufficient to elastically deform said plate-shaped element and to bring it into contact with the spacing member, heating the assembly to a temperature above the softening point of said sealing material but below the softening point of said plate-shaped glass element for a sufficient time to thereby form a vacuum-tight seal between the plate-shaped elements and convert the elastic deformation of said plate-shaped glass element obtained by the uniform pressure exerted on the surface thereof into a permanent deformation, evacuating and backfilling the space between said plate-shaped elements with an ionizable gas through said tubulation and sealing said tubulation.

2. Method of claim 1 wherein the step of exerting a pressure on the surfaces of the plate-shaped elements comprises reducing the pressure in the space between the plate-shaped elements during sealing to effectively maintain external pressure on said plate-shaped elements.

3. Method of claim 1 wherein the heating step comprises heating the assembly to a temperature which is approximately equal to the temperature at the lowest strain point of the plate-shaped glass element.

4. Method of claim 2 wherein the heating step comprises heating the assembly to a temperature which is approximately equal to the temperature at the lowest strain point of the plate-shaped glass element.

* * * * *